US007990244B2

(12) United States Patent
Huss et al.

(10) Patent No.: US 7,990,244 B2
(45) Date of Patent: Aug. 2, 2011

(54) INDUCTOR WINDER

(75) Inventors: John Huss, Roscoe, IL (US); Steven Schwitters, Rockford, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 888 days.

(21) Appl. No.: 11/985,780

(22) Filed: Nov. 16, 2007

(65) Prior Publication Data

US 2009/0128273 A1 May 21, 2009

(51) Int. Cl.
*H01F 27/30* (2006.01)

(52) U.S. Cl. ..... 336/198

(58) Field of Classification Search ..... 336/65, 336/83, 200–208, 232, 196, 198
See application file for complete search history.

(56) References Cited

U.S. PATENT DOCUMENTS 1,994,767 A * 3/1935 Heintz ..... 205/76
3,319,207 A * 5/1967 Davis ..... 336/229
4,639,707 A * 1/1987 Tanaka et al. ..... 336/185
4,724,603 A * 2/1988 Blanpain et al. ..... 29/606
4,975,672 A * 12/1990 McLyman ..... 336/198
5,214,403 A * 5/1993 Bogaerts et al. ..... 336/84 C
5,745,021 A 4/1998 Miyoshi et al.
6,512,438 B1 * 1/2003 Yoshimori et al. ..... 336/178

FOREIGN PATENT DOCUMENTS

JP 59-022307 A 2/1984

OTHER PUBLICATIONS

Official Search Report of the European Patent Office in counterpart foreign Application No. EP08253740 filed Nov. 11, 2008.

* cited by examiner

*Primary Examiner* — Tuyen Nguyen
(74) *Attorney, Agent, or Firm* — Kinney & Lange, P.A.

(57) ABSTRACT

An electrically insulating bobbin surrounds the magnetic core of an inductor. The bobbin includes a number of channels to receive wire for making an inductor. When wire is positioned in the channels, the wire is wound around the inductor core, but insulated from the inductor core and the other turns of wire. Because the bobbin insulates the turns of wire from each other and from the inductor core, bare rope wire can be used to wrap the inductor, resulting in reduced size and weight and improved ease of manufacture.

20 Claims, 6 Drawing Sheets

INDUCTOR WINDER

BACKGROUND OF INVENTION

The invention relates to inductors. More specifically, the invention relates to an apparatus for winding wire around an inductor core.

High power inductors require large diameter wire that is difficult to bend. In addition, many inductors, such as a common mode inductor, have multiple phases that must be electrically insulated from one another and from the magnetic core of the inductor. Typically, the phases of the inductor are isolated by using wire that is insulated with some type of rubber material. However, this insulating material adds to the stiffness of the wire and, as a result, the wire is more difficult to bend when wrapping the wire around the inductor core.

In addition, the insulation material around a wire adds to the total diameter of the wire, making the wound inductor larger than it would be if bare, uninsulated wire were used. When winding insulated wire around the magnetic core of the inductor, the wire bulges out away from the core, making the outer diameter of the inductor much larger than it should be. Also, use of rubber insulation reduces the ability of the wire to dissipate heat that is generated when the inductor is in use.

Toroids are often the geometry of choice in designing inductor cores. Toroids offer the smallest size (by volume and weight) and lower electromagnetic interference (EMI) than other shapes used for inductor cores. Toroidal geometry leads to near complete magnetic field cancellation outside of its coil, so the toroidal inductor has less EMI when compared against other inductors of equal power rating. Toroids also have the highest effective permeability of any core shape because they can be made from one piece of material. However, toroidal inductor cores have the particular disadvantage of being difficult to wind. Also, using insulated wire can create difficulty inserting wire into the inner diameter of a toroidal inductor core, and it increases friction between the various turns of the wire.

Therefore, there is a need in the art for a high power inductor that avoids the need for using insulated wire, thereby avoiding the problems resulting from the use of insulated wire. However, the different phases of the wire must still be electrically insulated from each other and from the magnetic core.

SUMMARY OF INVENTION

The invention is an electrically insulating bobbin surrounding the magnetic core of an inductor. The bobbin is made from an electrically insulating material that isolates the turns of an uninsulated wire that is wound around the magnetic core of the inductor. The turns of the uninsulated wire are electrically insulated from each other and from the inductor core.

DETAILED DESCRIPTION

Figure 1:
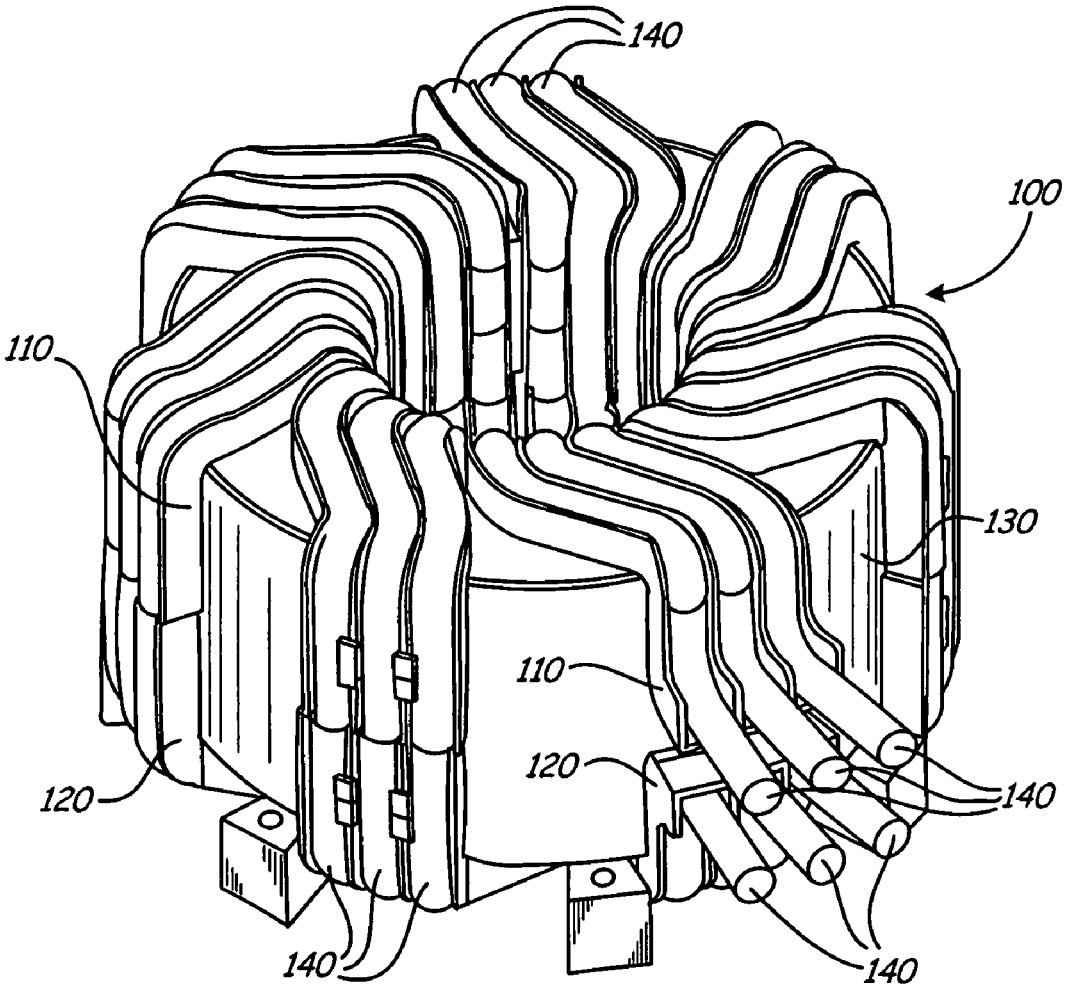
FIG. 1 shows an embodiment of the invention that has been placed around an inductor core and wound with wire.

FIG. 1 shows inductor assembly 100. Inductor assembly 100 includes upper bobbin 110, lower bobbin 120, inductor core assembly 130 and wire 140. Upper bobbin 110 and lower bobbin 120 are assembled around inductor core assembly 130. Wire 140 is wrapped around upper bobbin 110 and lower bobbin 120. Wire 140 does not include an outer layer of insulating material. Instead, upper bobbin 110 and lower bobbin 120 electrically isolate wire 140 from inductor core 130.

Figure 2:
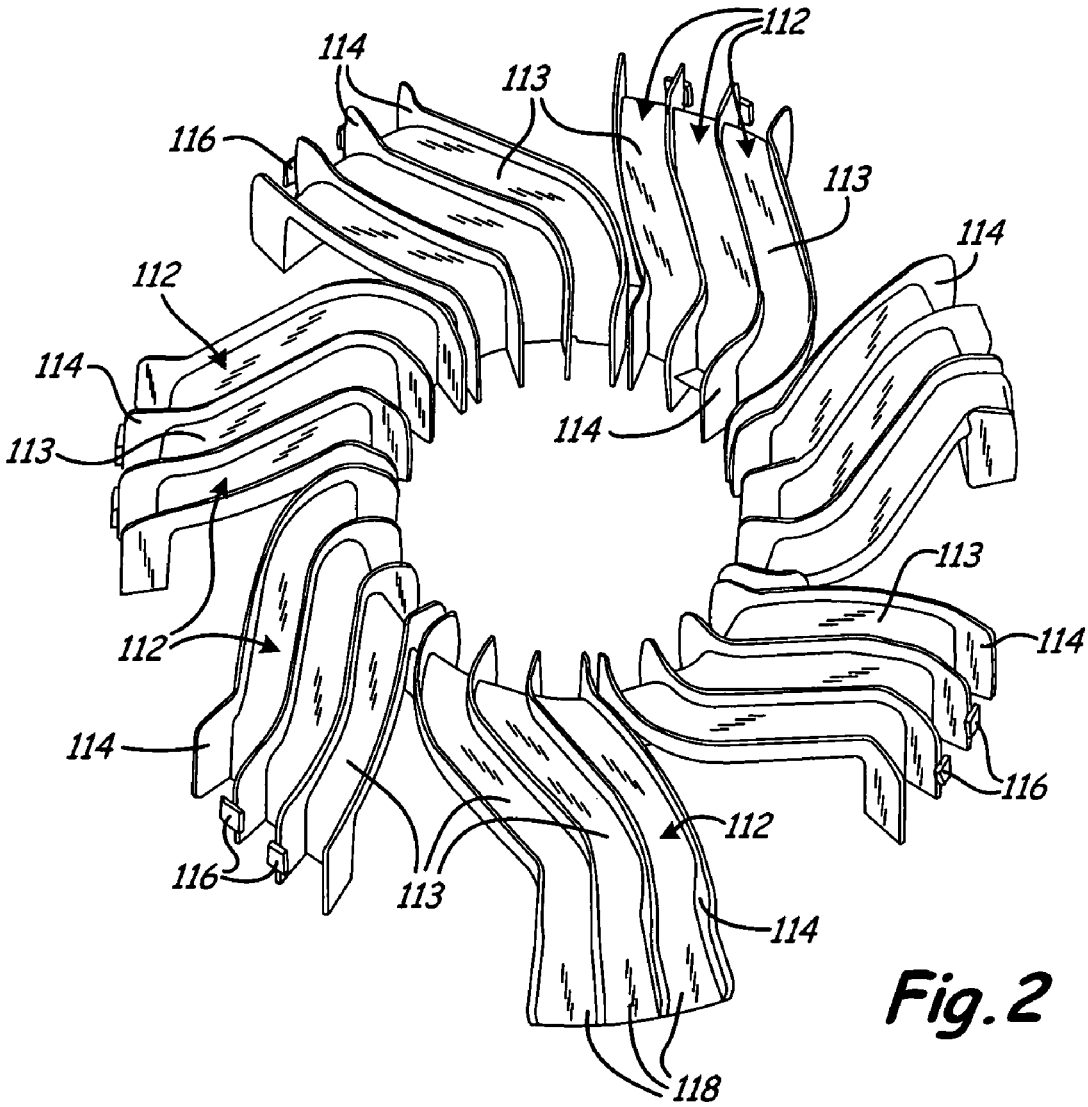
FIG. 2 shows the toroidal core of an inductor.

FIG. 2 shows upper bobbin 110. Upper bobbin 110 includes channels 112, which are formed by channel floors 113 and channel walls 114. Channels 112 are designed to contain wire that is wrapped around the bobbin, and channel floors 113 electrically isolate wire in channels 112 from an inductor core. Channel walls 114 separate multiple turns of wire in channels 112 from one another, and electrically isolate the turns of wire from one another. Upper bobbin 110 also includes containment tabs 116, which are positioned on the upper surface of channel wall 114 at the outer diameter of upper bobbin 110. When upper bobbin 110 is wound with wire, containment tabs 116 hold the wires that are positioned in channels 112 in place during and after winding. Wire inlet/outlet 118 is shaped to receive the end of wire that is wound on bobbin 110.

Figure 3:
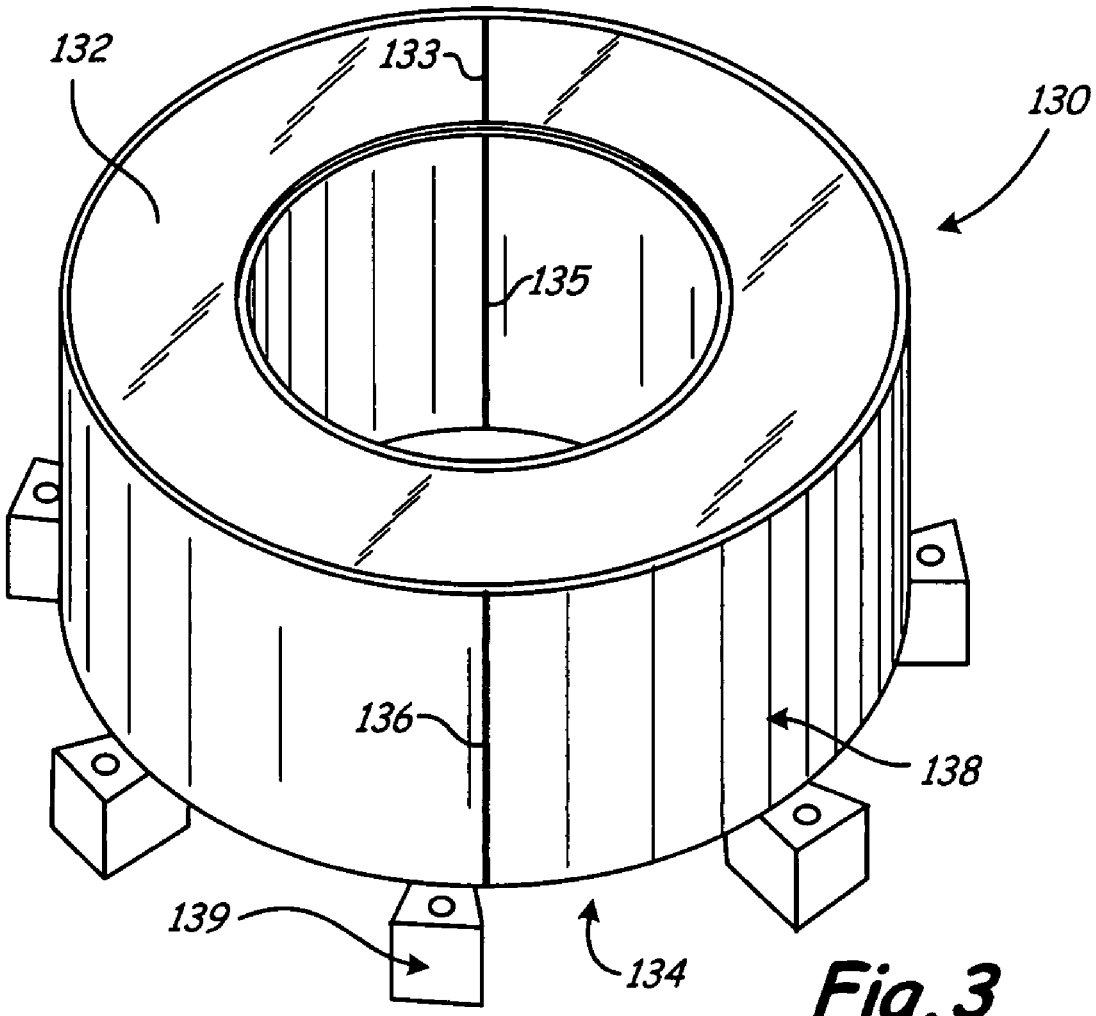
FIG. 3 shows one half of the insulating bobbin shown in FIG. 1.

FIG. 3 shows inductor core assembly 130. Inductor core assembly 130 includes magnetic inductor core 132, shell 138 and mounting feet 139. In this particular embodiment of the invention, inductor core 132 is shaped as a toroid and has a top surface 133, a bottom surface 134, an inner circumference 135 and an outer circumference 136. Shell 138 is thermally conductive and surrounds inductor core 132. Shell 138 dissipates heat that is generated by inductor core 132 when it is in use. Magnetic inductor core 132 is fragile, and therefore is typically bonded into place. Mounting feet 139 allow magnetic inductor core 132 and shell 138 to be mounted into place, and also provide a thermal path from inductor core 132 and shell 134 for dissipating heat.

Figure 4:
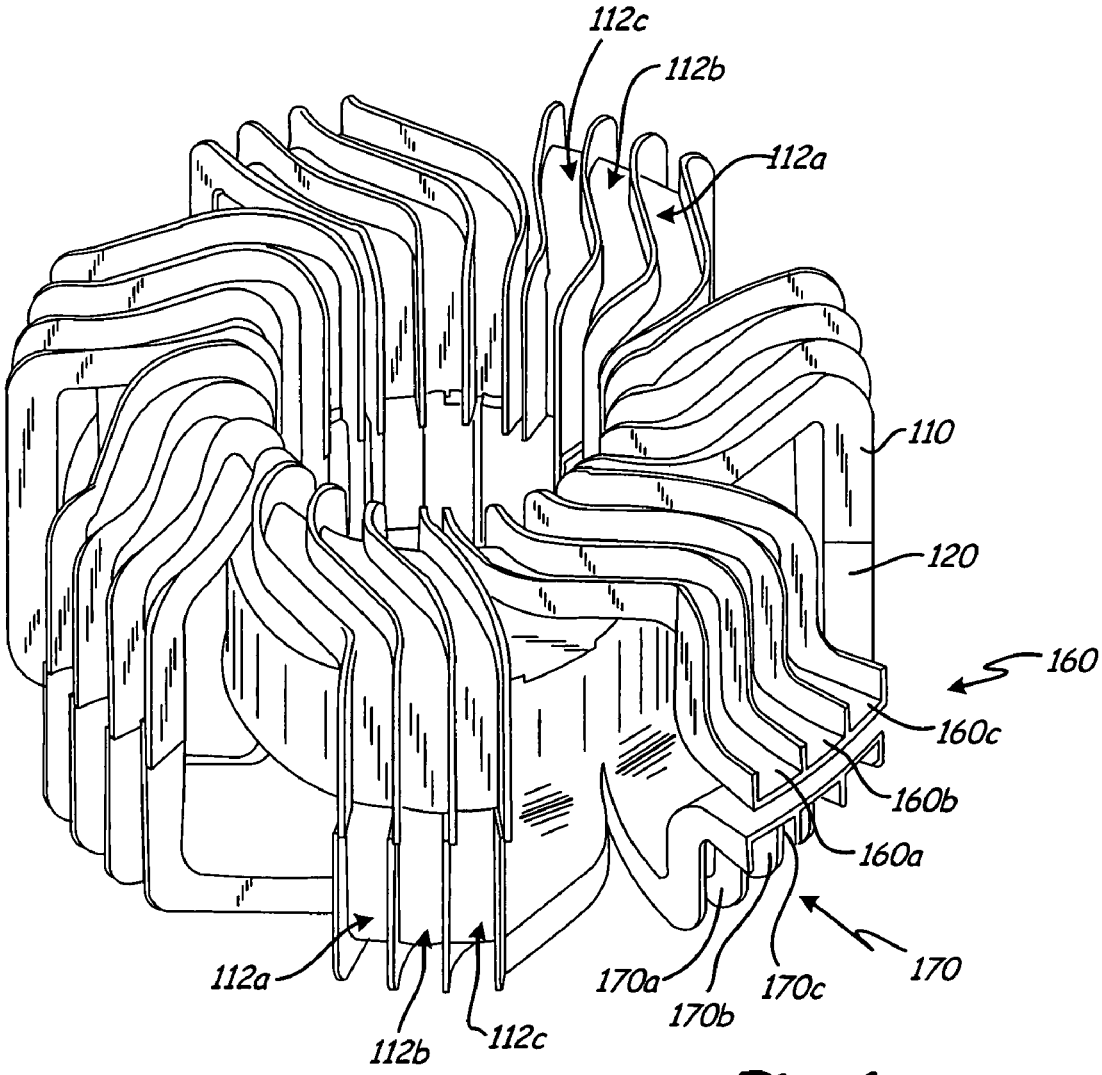
FIG. 4 shows an assembled insulating bobbin.

FIG. 4 shows upper bobbin 110 and lower bobbin 120 assembled together. Upper bobbin 110 and lower bobbin 120 are identical pieces with interlocking features that allow them to fit together to form the wire paths.

When the upper bobbin 110 and lower bobbin 120 are placed together, channels 112 form continuous, helical channels that extend from wire inlet 160 on upper bobbin 110, wrapping around the core seven times, to wire outlet 170 on lower bobbin 120. Thus, wire can be placed in channel 112, beginning at wire inlet 160 and ending at wire outlet 170, and the wire can be wrapped around inductor core assembly 130, creating multiple turns of wire around inductor core assembly 130. When positioned in channels 112, wire 140 travels in a helical path around inductor core assembly 130. Wire inlet 160 and wire outlet 170 open up and spread out to allow insulating sheathing to be placed over the wires to isolate them from each other.

In the embodiment of the invention shown in FIG. 4, there are three separate channels 112, designated in FIG. 4 as channels 112*a*, 112*b* and 112*c*. When upper bobbin 110 and lower bobbin 120 are wound with wire, one wire is positioned at wire inlet 160*a*, wound through channel 112*a* until it reaches wire outlet 170*a*. The embodiment of the invention shown in FIG. 4 is designed to work with a toroid-shaped inductor core. Thus, the wire positioned at wire inlet 160*a* begins on the outer circumference of inductor core assembly 130, travels across the top surface of inductor core assembly 130, wraps around the inside circumference of inductor assembly 130, travels across the bottom surface of inductor core assembly 130, until it returns to the outer circumference of inductor core assembly 130. This winding through channel 112*a* creates one winding around inductor core assembly 130. In the embodiment of the invention shown in FIG. 4, channel 112 travels around inductor core assembly 130 seven times, thus creating one winding of seven turns.

Similarly, another wire is positioned at wire inlet 160*b* and wound through channel 112*b* until it reaches wire outlet 170*b*, while a third wire is positioned at wire inlet 160*c* and wound through channel 112*c* until it reached wire outlet 170*c*. These three wires in combination create three phases of seven windings each around inductor core assembly 130. Channels 112*a*, 112*b* and 112*c* are designed so that all of the turns of the three phases are evenly distributed around inductor core assembly 130. Even distribution of the turns provides electrical and magnetic balance to inductor assembly 100.

While the embodiment of the invention shown in FIGS. 1-4 is a three phase inductor with seven windings per phase, the number of phases and turns is purely exemplary. One skilled in the art will recognize that the invention can be applied to inductors with any number of phases and any number of turns.

In addition, while the embodiment of the invention shown in FIGS. 1-4 is applied to an inductor with a toroidal core and may find particular application in toroidal inductors because of the problems inherent in winding wire around toroids, one skilled in the art will recognize that the invention could also be applied to inductors that use cores made with any other shape, as well.

After upper bobbin 110 and lower bobbin 120 have been positioned around inductor core assembly 130, the bobbins are wound with wires 140 (see FIG. 1). Wires 140 are uninsulated rope wire that is more flexible and has a smaller diameter than the insulated wires that are typically used to wind inductors. Wires 140 are very flexible and will stay in channels 112 with the assistance of containment tabs 116.

When wires 140 are positioned in channels 112, they are only isolated on three sides of the wire by channel floors 113 and channel walls 114. To completely insulate wire 140, the entire inductor assembly 100 may be potted in an electrically insulating compound to completely isolate the wires from each other. This compound should also be thermally conductive to allow heat to be dissipated from inductor assembly 100.

Upper bobbin 110 and lower bobbin 120 may each be made as a single piece, as shown in FIG. 2. Upper bobbin 110 and lower bobbin 120 may, for example, be made by injection molding. The bobbins are made of an electrically insulating material, preferably a plastic material that may be injection molded. Ideally, the material used to make upper bobbin 110 should be thermally conductive, as well as electrically insulating, such as Ultem® thermoplastic resin.

Figure 5A:
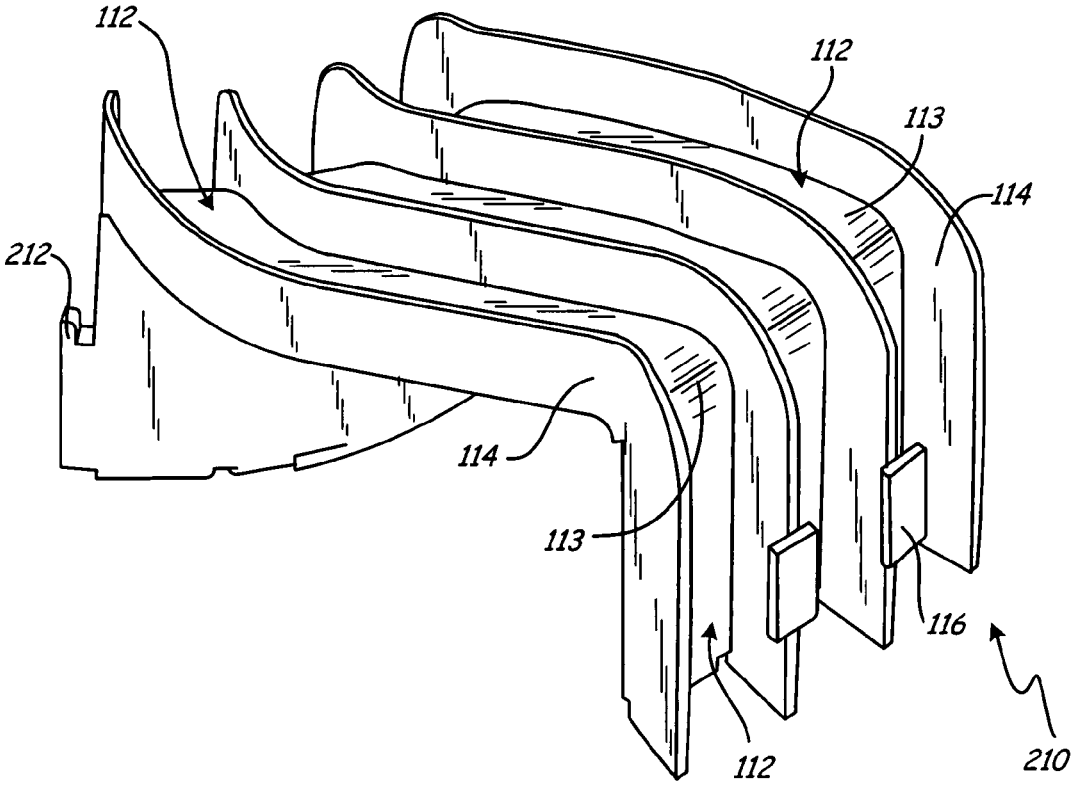
FIG. 5*a* shows a modular component of an alternate embodiment of the invention.
Figure 5B:
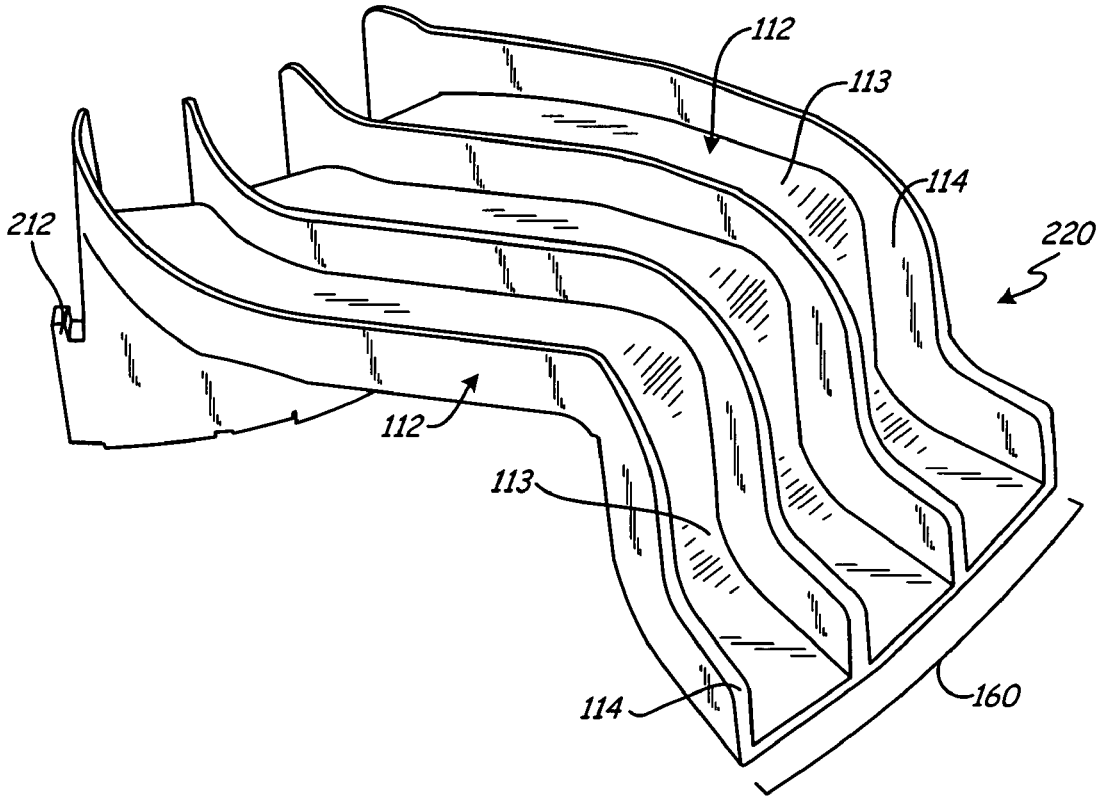
FIG. 5*b* shows a modular component of an alternate embodiment of the invention.

FIG. 5*a* and FIG. 5*b* show an alternate embodiment of the invention. In this embodiment, upper bobbin 110 and lower bobbin 120, rather than each being made as a single piece, are each composed of multiple identical turn sections 210 and a single inlet/outlet section 220. As with upper bobbin 110 and lower bobbin 120, turn section 210 includes channels 112, channel floors 113, channel walls 114 and containment tabs 116. Inlet/outlet section 220 includes channels 112, channel floors 113, channel walls 114 and channel inlet/outlet 160. In addition, turn section 210 and inlet/outlet section 220 include connection tabs 212 for connecting turn sections with each other or with an inlet/outlet section.

Each of turn sections 210 and inlet/outlet section 220 are made individually and then bonded together to form upper and lower bobbins. Thus, for example, upper bobbin 110 could be assembled by connecting six turn sections 210 and one inlet/outlet section 220 to form the fully assembled upper bobbin 110. Similarly, lower bobbin 120 could be assembled by connecting six turn sections 210 and one inlet/outlet section 220. When connected together, turn sections 210 and inlet/outlet sections 220 form continuous channels 112 that form continuous, helical channels that extend around an inductor core.

Of course, as noted previously, the number of turns and phases of this particular embodiment is purely exemplary. Any number of turns and phases of an inductor could be used and still come within the scope of this invention. Turn section 210 and inlet/outlet section 220 could be designed to create any number of turns and any number of phases and still fall within the scope of the invention.

The invention is a bobbin for winding wire around an inductor core. The bobbin is made from an electrically insulating material and provides channels through which an uninsulated wire may be wound. Each of the channels have a channel floor that insulates the wire from a magnetic inductor core, and also have insulating walls that electrically insulate the wires from each other. Because the inductor may be wound with uninsulated wire, it is easier to wind the wire, the inductor can be made more compactly, and it is easier to remove excess heat from the inductor. Also, the total size and weight of the inductor is generally smaller than an inductor wound with insulated wire. Moreover, use of the insulating bobbin leads to more consistent assembly of inductors, because the channels of the bobbin guide the location of the wires. Finally, the elimination of insulation around the wires eliminates a thermal interface, resulting in improved heat dissipation, particularly when the wound conductor is covered with a potting material.

Although the present invention has been described with reference to preferred embodiments, workers skilled in the art will recognize that changes may be made in form and detail without departing from the spirit and scope of the invention.

The invention claimed is:

1. An assembly for positioning wire around an inductor core, the assembly comprising:

a plurality of adjacent helical channels for receiving wire, each channel extending in a continuous helical path around the inductor core;

each helical channel having a floor insulating the channel from the inductor core; and each helical channel having at least one side wall insulating the channel from each adjacent channel.

2. The assembly of claim 1 further comprising a tab for retaining wire on at least one side wall.

3. The assembly of claim 1 wherein each channel has an inlet.

4. The assembly of claim 1 wherein each channel has an outlet.

5. The assembly of claim 1 wherein the assembly comprises polyetherimide resin.

6. The assembly of claim 1 wherein the inductor core is shaped as a toroid having an inner circumference and an outer circumference, the assembly further comprising:

the continuous helical path of the channels traversing the outer circumference and the inner circumference of the inductor core.

7. An assembly for positioning wire around an inductor core, the assembly comprising:

a top assembly section comprising:

a first plurality of adjacent helical channel sections;

each helical channel section having a floor insulating the channel section from the inductor core;

each helical channel section having at least one side wall insulating the channel section from each adjacent channel section;

a bottom assembly section comprising:

a second plurality of adjacent helical channel sections;

each helical channel section having a floor insulating the channel section from the inductor core;

each helical channel section having at least one side wall insulating the channel section from each adjacent channel section; and the bottom assembly section configured to attach to the top assembly section to surround the inductor core and to form continuous channels for receiving wire extending in a continuous helical path around the inductor core.

8. The assembly of claim 7 further comprising a tab for retaining wire on at least one side wall.

9. The assembly of claim 7 wherein each channel has an inlet.

10. The assembly of claim 7 wherein each channel has an outlet.

11. The assembly of claim 7 wherein the assembly sections comprise polyetherimide resin.

12. The assembly of claim 7 wherein the inductor core is shaped as a toroid having an inner circumference and an outer circumference, the assembly further comprising:

the continuous helical path of the channels traversing the outer circumference and the inner circumference of the inductor core.

13. An assembly for positioning wire around an inductor core, the assembly comprising:

a plurality of modular sections comprising:

a plurality of adjacent helical channel sections;

each helical channel section having a floor insulating the channel section from the inductor core;

each helical channel section having at least one side wall insulating the channel section from each adjacent channel; and each modular bobbin section configured to mate with other modular bobbin sections to surround the inductor core and to form continuous channels for receiving wire extending in a continuous helical path around the inductor core.

14. The assembly of claim 13 further comprising a tab for retaining wire on at least one side wall.

15. The assembly of claim 13 wherein each channel has an inlet and an outlet.

16. The assembly of claim 13 wherein the modular bobbin sections comprise polyetherimide resin.

17. The assembly of claim 13 wherein the inductor core is shaped as a toroid having an inner circumference and an outer circumference, the assembly further comprising:

the continuous helical path of the channels traversing the outer circumference and the inner circumference of the inductor core.

18. The assembly of claim 1, wherein at least one channel contains a length of uninsulated wire.

19. The assembly of claim 7, wherein at least one channel contains a length of uninsulated wire.

20. The assembly of claim 13, wherein at least one channel contains a length of uninsulated wire.

* * * * *

UNITED STATES PATENT AND TRADEMARK OFFICE

CERTIFICATE OF CORRECTION

PATENT NO. : 7,990,244 B2
APPLICATION NO. : 11/985780
DATED : August 2, 2011
INVENTOR(S) : John Huss et al.

It is certified that error appears in the above-identified patent and that said Letters Patent is hereby corrected as shown below:

Col. 6, Line 1
Insert --bobbin-- after "a plurality of modular"

Signed and Sealed this
Eighteenth Day of October, 2011

David J. Kappos

David J. Kappos
*Director of the United States Patent and Trademark Office*